US006279290B1

(12) United States Patent
Richardson

(10) Patent No.: US 6,279,290 B1
(45) Date of Patent: Aug. 28, 2001

(54) ROOF BEAMS WITH POSITIVE ENGAGEMENT BETWEEN CROSS BAR AND LOWER CAPPING

(75) Inventor: Christopher Richardson, Clitheroe (GB)

(73) Assignee: Ultraframe PLC of Enterprise Works (GB)

( * ) Notice: Subject to any disclaimer, the term of this patent is extended or adjusted under 35 U.S.C. 154(b) by 0 days.

(21) Appl. No.: 09/606,267

(22) Filed: Jun. 29, 2000

Related U.S. Application Data

(62) Division of application No. 08/900,477, filed on Jul. 25, 1997, now Pat. No. 6,122,886.

(30) Foreign Application Priority Data

| | | |
|---|---|---|
| Jul. 26, 1996 | (GB) | 9615743 |
| Sep. 11, 1996 | (GB) | 9618984 |
| Mar. 12, 1997 | (GB) | 9705044 |

(51) Int. Cl.[7] ..... E04C 3/00

(52) U.S. Cl. ..... 52/734.2; 52/734.1; 52/282.1; 52/461

(58) Field of Search ..... 52/734.2, 734.1, 52/783.13, 204.53, 204.595, 204.67, 200, 204.71, 201, 282.1, 461, 465, DIG. 17

(56) References Cited

U.S. PATENT DOCUMENTS

| | | | |
|---|---|---|---|
| 2,668,509 | | 2/1954 | Fox-Williams . |
| 3,199,258 | | 8/1965 | Jentoft et al. . |
| 3,340,657 | * | 9/1967 | Thomas ..... 52/DIG. 17 X |
| 3,994,471 | | 11/1976 | Turolla . |
| 4,222,210 | | 9/1980 | Hanstein et al. . |
| 4,385,850 | | 5/1983 | Bobath . |
| 4,439,969 | | 4/1984 | Bartlett . |
| 4,463,534 | * | 8/1984 | Crigler ..... 52/395 |

FOREIGN PATENT DOCUMENTS

| | | |
|---|---|---|
| 90 13 199.1 | 9/1990 | (DE) . |
| 0092 078 A2 | 3/1983 | (EP) . |
| 517508 | 7/1938 | (GB) . |
| 535730 | 7/1939 | (GB) . |
| 639227 | 8/1947 | (GB) . |
| 930642 | 1/1959 | (GB) . |
| 1038123 | 3/1962 | (GB) . |
| 1234711 | 3/1969 | (GB) . |
| 1549279 | 3/1976 | (GB) . |
| 2273114A | 11/1992 | (GB) . |
| 2275958A | 2/1994 | (GB) . |
| WO93/25779 | 12/1993 | (WO) . |

* cited by examiner

*Primary Examiner*—Christopher T. Kent
*Assistant Examiner*—Brian E. Glessner
(74) *Attorney, Agent, or Firm*—Howell & Haferkamp LC

(57) ABSTRACT

A roof beam for constructing a conservatory roof comprises a glazing bar (10) and upper and lower capping (12, 14/50) thereon. The glazing bar has a cross bar (16) having trough formations (26) at each end, whereby there is a recess under the cross bar. The cross bar can, therefore, accommodate both a lower capping (14) for a transom roof beam and a lower capping (50) for a hipped conservatory roof end.

11 Claims, 12 Drawing Sheets

870
872
800
802
814
856
804
807
808

870
812
800
806
802
804
807
808

862
864
850
852
854

860
850
852
802

862
864
854
852
850
814
856
852

860
850
854
852

ROOF BEAMS WITH POSITIVE ENGAGEMENT BETWEEN CROSS BAR AND LOWER CAPPING

This is a divisional of application Ser. No. 08/900,477; filed on Jul. 25, 1997 now U.S. Pat. No. 6,122,886.

BACKGROUND OF THE INVENTION (1) Field of the Invention

This invention concerns roof beams, especially for use in constructing conservatories and like structures having roofs comprising panels usually of translucent material supported between roof beams.

(2) Description of the Related Art

Translucent panels for conservatory roofs are generally sandwiched at their edges between upper and lower roof beam forming extrusions or cappings coupled to a glazing bar, usually of aluminum. To provide a good seal above and below the translucent panels, provisions are made for the roof beam to retain gaskets in suitable positions.

Upper roof beam forming extrusions or cappings may have gaskets formed integrally with panel contacting edges thereof and gaskets for the underside of the panels are usually retained in special formations of the aluminum glazing bars. These gaskets have to be fitted to the extrusions on site which takes up time. Also, the extrusions are more expensive to produce because of the additional gasket retaining formations required.

Furthermore, in order to retain the lower beam forming cappings, the aluminum glazing bars require further formations on which the lower beam cappings can locate.

In our co-pending British Patent Application No. 2275958A it was proposed to provide a roof beam construction for use in constructing conservatory roofs comprising a glazing bar and upper and lower cappings therefor having gaskets formed integrally on edges thereof between which a roofing panel is to be retained and means for locating the cappings on said glazing bar, wherein the means for locating the lower capping on the glazing bar comprises the integrally formed gaskets, which in use are trapped between the glazing bar and roofing panel.

The lower cappings are formed with either a flat base or with a base having a pair of angled longitudinal facets. For each type of capping the glazing bar, generally an inverted T in section, has its cross bar correspondingly shaped, i.e. either flat or with two angled facets. In forming Victorian style conservatories, both types of glazing bar will usually be used. The glazing bars with the flat base and corresponding cappings are usually used as transom bars extending from opposite sides of a ridge of the conservatory to the eaves and the angled base glazing bars with corresponding cappings are used for forming the Victorian roof end, which is formed with triangular section roofing panels. Thus, in forming a Victorian style conservatory, two different types of glazing bar and lower cappings are required, which adds to the cost. Furthermore, care has to be taken when erecting such a conservatory to ensure that glazing bars are installed in the correct positions.

SUMMARY OF THE INVENTION

A first object of this invention is to provide a glazing bar for construction of roof beams for conservatories, which may have universal application for transom and Victorian situations as defined above.

According to a first aspect of the invention there is provided a glazing bar for use in forming roof beams of conservatory roofs, the glazing bar being of generally inverted T-section having an, in use, upstanding limb to which an upper capping may be fixed, and a cross bar having a central section and edges, the edges being shaped to extend below the central section to form a recess in the underside of the cross bar.

In one preferred embodiment of the invention, the edges of the cross bar may be in the form of troughs extending below the central section of the cross bar. The troughs of the cross bar are preferably formed with outer side walls that also have inward returns. The side walls are preferably in planes parallel to the plane of the upstanding limb. The inward returns of the side walls preferably have arcuate top surfaces.

The overall height of the cross bar side walls may be chosen to receive transom and Victorian style lower cappings of the same or a similar depth, whilst the recess on the underside of the cross bar can accommodate the angled facets of the Victorian lower capping base. The glazing bars of the invention may also accommodate glazing panels at a variety of angles. Furthermore, as the same glazing bars may be used for transom situations and for roof end situations where glazing panels are angled relative to each other, it may be possible to use the same size top cappings on both rather than having to use a larger size top capping on the roof end glazing bars.

Where the cross bar recess is formed by continuations of side walls below the cross bar, these continuations may be shaped so as to provide means of engagement with cooperating formations of a lower capping for the glazing bar. Such engagements may comprise, for example, corresponding hook like formations or may comprise ribs that snap fit into channels. Such channels are preferably formed internally of the lower cappings.

Thus, with this type of formation for the cross bar, a capping having either a flat base or an angled facet base can be accommodated thereon, so that the need for two different formations of glazing bar can be eliminated. By having the top surfaces of the inward returns of the side walls arcuate or curved, integral gaskets on top edges of the capping can be accommodated irrespective of the angle of the co-extruded gasket.

The inward returns of the side walls preferably also have top surfaces that are profiled or roughened in order to provide improved grip for the capping on the underside of the cross bar especially for co-extruded gaskets on edges of cappings, which in use are sandwiched between the glazing bar and glazing panels.

Conveniently the troughs at each side of the glazing bar cross bar provide drainage channels for collecting and directing water which has penetrated the roof beam, so that it can run off via the roof eaves. To improve drainage further, it is preferred that the central section of the glazing bar cross bar be inclined downwards from each side of its junction with the upstanding limb, so that any water collected in the glazing bar can run into the troughs. As any fixings made between the glazing bar and other conservatory components at the ridge or eaves will generally be made in the central section, such as by way of screws or bolts, it is advantageous to have the extra drainage facility, so that water cannot collect around such fixings and cause corrosion.

For some situations, especially in large conservatory constructions, where glazing bars will be unsupported over a considerable length, there is a risk of them twisting.

A second object of the invention is to provide a glazing bar for construction of roof beams for conservatories which may have resistance to twisting forces, especially in unglazed condition, such as may be caused by uneven or eccentric loadings on opposite sides of a glazing bar.

According to a second aspect of the invention there is provided a glazing bar for use in forming a conservatory roof beam, the glazing bar being of generally inverted T-section and having its upstanding limb in the form of a hollow section duct.

The cross bar of the glazing bar according to this aspect of the invention may be of a prior art type as described above or may be of a type as defined according to the first aspect of the invention.

The upstanding limb of the glazing bar of this aspect of the invention may be of any suitable cross section. One suitable cross section is a rectangular cross section but a tapered section either upwardly or downwardly, such as of a triangular cross section, may also be very suitable for the invention, especially in the form of an isosceles triangle either way up. A triangular section duct is believed to be advantageous in providing a self resolving shape for lateral forces.

Another type of glazing bar according to this aspect of the invention has two or more ducts, preferably spaced apart by single web stems. Preferably such ducts are of rectangular, especially square, section.

Generally the double web duct should be as small as possible without losing the advantage of strength. That is to facilitate extrusion of that type of glazing bar, say from aluminum or aluminum alloy, it being easier to extrude smaller rather than larger enclosed sections. A preferred shape for the duct has a flat top and convergent sides from the flat top to a curved base.

The ducts of glazing bars according to this aspect of the invention, as well as giving torsional stability to the glazing bars, may also be used to carry service cabling or piping and to provide locations for connecting members, such as fixing cleats or brackets of a tenon type. Furthermore, hollow duct glazing bar have improved "U" values compared to single stem glazing bars.

Glazing bars of the invention may be secured to other components of a roof system by means of screws, bolts or the like through the cross bars thereof. However, for some situations end fixing of glazing bars may be desirable. For that purpose the upstanding limb of a glazing bar may be formed with a screw or bolt port to receive same in a longitudinal direction of the glazing bar. As the glazing bars of the invention will normally be formed as extrusions, the port will run the length of a glazing bar section and be available, therefore, at opposite ends of the glazing bar to receive a screw, bolt or other suitable fixing.

For glazing bars having a single web upstanding limb, the screw port will conveniently be situated just above its junction with the cross bar or at the intersection of the upstanding limb and cross bar.

For glazing bars having their upstanding limb in the form of a hollow duct i.e. having two upstanding webs, the screw port may be formed as part of the duct preferably either at or just above the base thereof. Alternatively, the screw port may be formed in a single web upstand between the cross bar and a double web duct. The invention further provides a roof beam comprising a glazing bar of either aspect of the invention with upper and lower cappings fitted thereto.

A preferred lower capping is of extruded plastics material, such as PVC, and is preferably formed as a channel section with either a flat base or with a base having a pair of angled longitudinal facets. The gasket material is preferably co-extruded onto the capping and is preferably of rubber or a synthetic elastomeric material. The gaskets preferably extend inwards from opposite sides of the channel and may have deformable resilient ribs or the like, especially at edges and also possibly centrally thereof to provide a good seal when compressed. Preferred gaskets are generally arcuate in section, so that they are concave on their underside. This feature may be of advantage in fitting the cappings to glazing bars by allowing more room for the gaskets to be slipped over edges of the glazing bar cross bar. Internally of the lower cappings are preferably one or more spaced projections or ribs to ensure correct alignment of the glazing bar and capping when fitted together.

The lower cappings may have their bases formed with a relatively flexible mid-section, which may facilitate fitting thereof to glazing bars. In one preferred form the lower capping base is formed with a co-extruded rubber or elastomeric strip centrally thereof along its length.

The upper capping may be of any desired cross-section provided that it has at least one depending edge on which a gasket is formed. The preferred upper capping is formed by extrusion of plastics material, such as PVC, and has gaskets co-extruded onto its depending edge or edges, again preferably of rubber or of synthetic elastomeric material. Internally of the upper capping there is preferably a means for coupling the capping to the glazing bar. Preferably resilient formations depend from the inside of the capping, which formations have outward projections thereon and these formations locate in an upwardly open channel of the glazing bar which has a series of internal recesses or notches for receiving said projections. The provision of a series or recesses or notches for receiving the projections allows the resilient depending formations of the capping to be pressed down into the glazing bar any desired distance depending on the thickness of the roofing panel or panels which is or are being secured in place by the capping and make a snap fit.

The upwardly open channel preferably has converging sides leading to first notches. The converging sides may be planar or curved. The channel is preferably sufficiently deep with sufficient notches or recesses to receive a single size capping irrespective of the depth of the glazing panels being accommodated. A series of two notches or recesses on each side of the channel, may be sufficient for most purposes provided the channel is deep enough.

A roof beam according to the invention may be formed for locating the roofing panel on one side thereof, such as when the other side of the beam is to be secured to a wall or may be formed for locating roofing panels on opposite edges thereof for use intermediate edges of the roof structure.

BRIEF DESCRIPTION OF THE DRAWINGS

This invention will now be further described by way of example only, with reference to the accompanying drawings, in which.

DETAILED DESCRIPTION OF THE INVENTION

Figure 1:
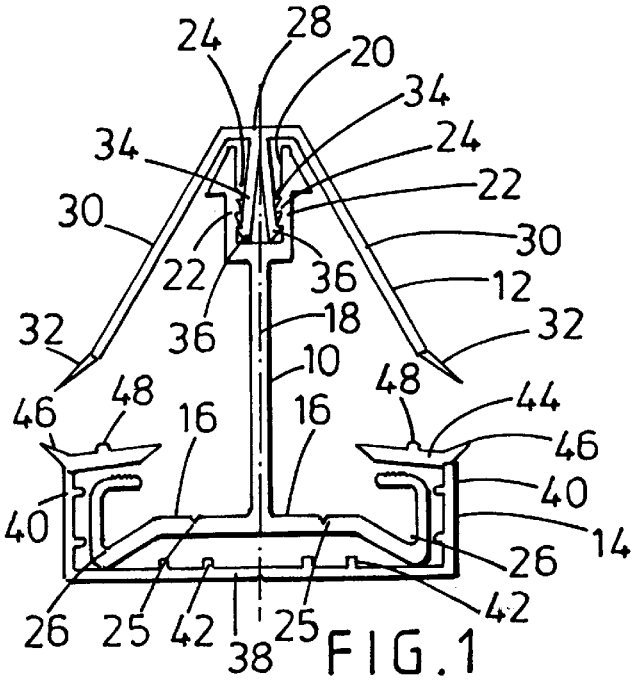
FIG. 1 shows a first roof beam arrangement according to the invention.

Referring to FIG. 1 of the accompanying drawings, a roof beam arrangement for forming conservatory or like roofs comprises a glazing bar 10, an upper capping 12 and a lower capping 14. In use roofing panels, such as of translucent plastics material, for example polycarbonate, will have their edges sandwiched between the upper capping 12 and the lower capping 14 on opposite sides of the roof beam arrangement.

The glazing bar 10 is extruded from aluminum and is generally of T-section but inverted in use. Thus, the glazing bar 10 has a pair of flanges 16, which are turned back on themselves at their remote ends, and an upstanding limb 18 which is bifurcated to form an upwardly open channel 20 having generally parallel sides 22. On the inside of each side 22 is a series of notches 24 forming downwardly open recesses.

Each flange 16 has a first part 25 generally perpendicular to the upstanding limb 18 and a second part which forms a trough 26 remote from the upstanding limb 18. The upper capping 12 is extruded from PVC and is generally of inverted V-section but comprises a flat top 28 and depending sides 30. The remote edges of the sides 30 have gaskets 32 formed thereon by co-extrusion of rubber or synthetic elastomeric material. Internally of the capping 12 and depending from its flat top 28 are a pair of resilient divergent flaps 34 having outwardly projecting lips 36 at their ends.

The lower capping 14 is also extruded from plastics material, such as PVC, and is generally formed as a channel section having a flat base 38 and upstanding side walls 40. Internally of the channel on the base 38 and on the side walls 40 are spacing projections 42. The free edges of the side walls 40 have co-extruded thereon, from rubber or synthetic elastomeric material, gaskets 44 which extend inwardly and are inclined slightly upwardly. The gaskets 44 include resilient deformable projections 46 and 48 on their upper surface along their outermost edge and centrally thereof respectively.

FIG. 1 illustrates a typical transom roof beam but the same glazing bar and upper capping can be used with a different lower capping to form a Victorian style roof beam, in which the lower capping 50 has its base formed from a pair of longitudinal facets 52 angled relative to each other to form a concave surface when viewed from below. The capping has side walls 53 each perpendicular to its adjoining facet 52. Atop each side wall is a co-extruded gasket 55 extending inwardly and upwardly. As can be seen by comparison of FIGS. 1 and 2 both the flat base lower capping 14 and the faceted lower capping 50 can be accommodated on the same glazing bar 10. That is because for both lower cappings the distance between the coextruded gasket and the base is the same, whilst the longitudinal central recess formed underneath the cross bar of the glazing bar lower capping accommodates the angled facets 52 of the base of the Victorian style lower capping 50.

Figure 3:
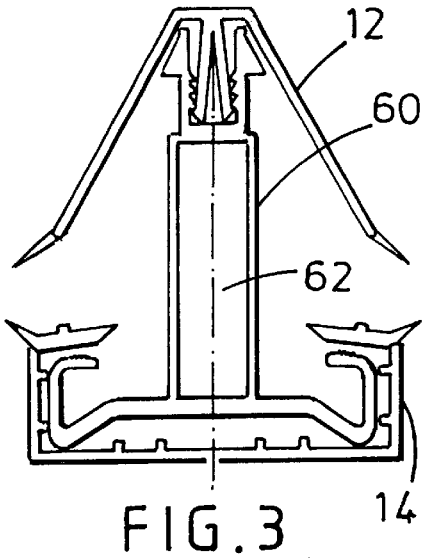
FIG. 3 shows a third roof beam arrangement according to the invention.
Figure 2:
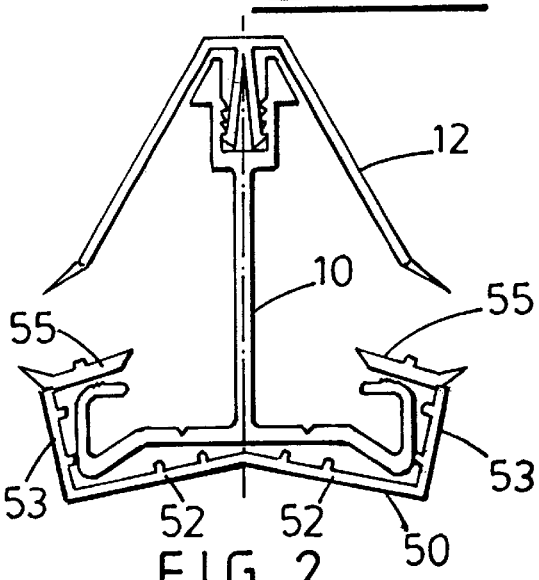
FIG. 2 shows a second roof beam arrangement according to the invention.
Figure 4:
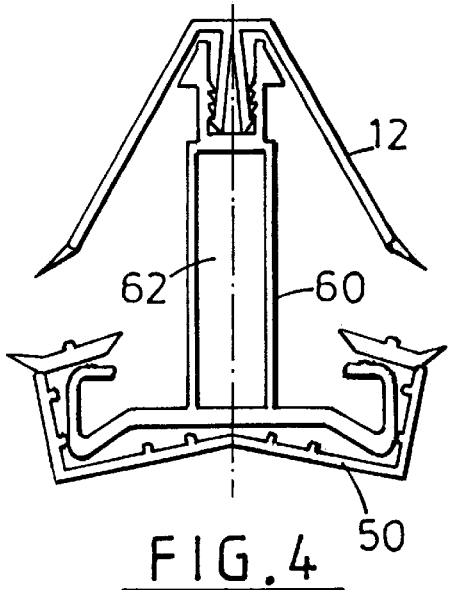
FIG. 4 shows a fourth roof beam arrangement according to the invention.

FIGS. 3 and 4 of the accompanying drawings show similar arrangements to those of FIGS. 1 and 2 respectively except that the glazing bar 60 is of a reinforced type suitable for longer spans of roof beam, where torsional rigidity is desirable which has its upstanding limb 62 formed as a hollow section rectangular duct, which is less prone to twisting because of its double wall effect.

Figure 5:
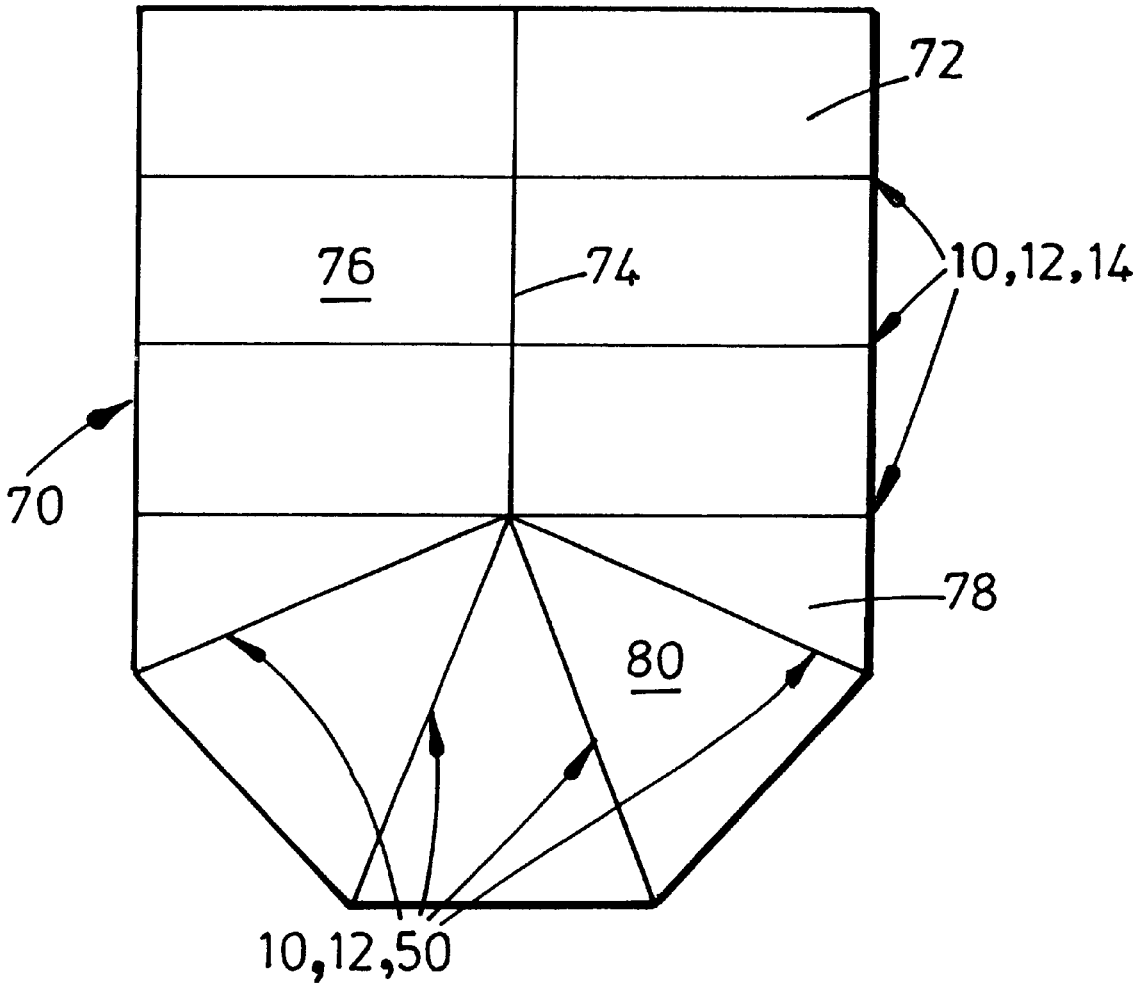
FIG. 5 shows a schematic plan view of a typical Victorian style conservatory.

FIG. 5 of the accompanying drawings shows where the different types of roof beam illustrated in FIGS. 1 and 2 or FIGS. 3 and 4 may be used in forming a Victorian style conservatory 70. Typically a Victorian style conservatory 70 has a first part 72 having a central 74 ridge with rectangular roofing panels 76 sloping down from the ridge and supported between roof beams of the type of FIG. 1 or of FIG. 3 of the accompanying drawings, which have the lower cappings 14 with flat bases. One end of the ridge 74 will usually be abutted against another building and at the opposite end of the ridge is a bow end 78 having its roof formed of triangular section roofing panels 80 sloping down to the eaves. In this section of the conservatory the roof beams will be of the type shown in FIG. 2 or 4 of the accompanying drawings which are generally known as Victorian style roof beams.

Figure 6:
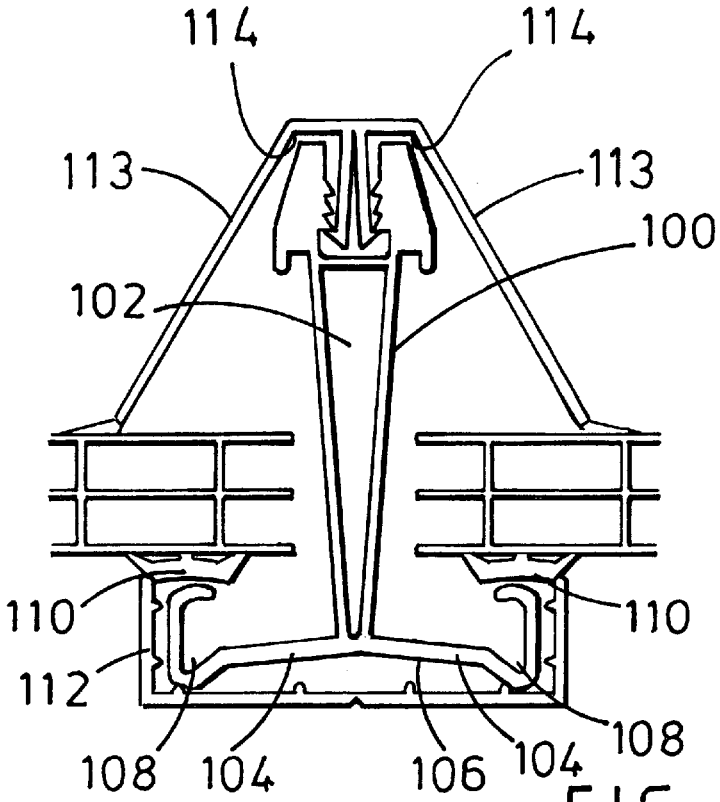
FIG. 6 shows a fifth roof beam arrangement according to the invention.
Figure 7:
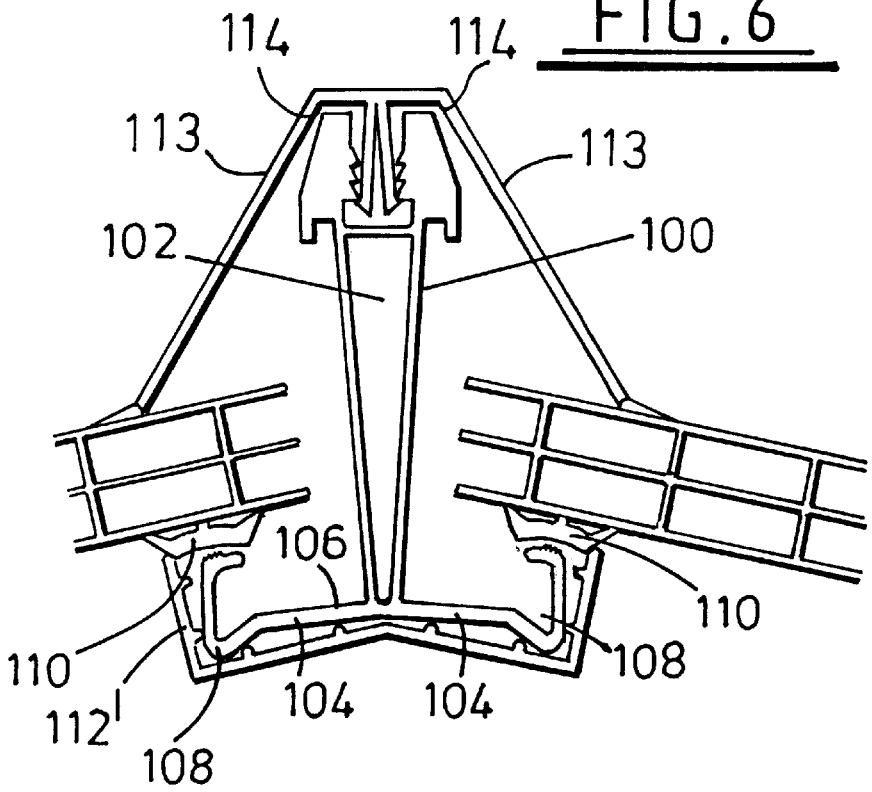
FIG. 7 shows a sixth roof beam arrangement according to the invention.

FIGS. 6 and 7 of the accompanying drawings show two other roof beam versions with glazing panels in place and having modifications that may be used in any one of the roof beams shown in FIGS. 1 to 4 of the accompanying drawings. In particular, it is to be noted that the glazing bars 100 shown in FIGS. 6 and 7 are of a type designed for torsional rigidity by having a hollow section upstanding limb 102. The hollow section is in the form of a inverted isosceles triangle.

Secondly, the first part of each flange 104 of the cross bar 106 of the glazing bar 100, instead of being perpendicular to a plane splitting the upstanding limb 102, slopes down towards its own trough 108 to improve water run off into the trough.

Thirdly, the co-extruded gaskets 110 on each side of the lower cappings 112, 112' respectively are arcuate in section being concave on the underside, so as to more easily accommodate the inward returns of the side walls of the glazing bars and to facilitate fitting of the capping to the glazing bar. These gaskets are not generally inclined upwards compared to the corresponding gaskets of FIGS. 1 to 4 but are more or less perpendicular to the lower capping side walls.

Fourthly, the top cappings 113 are generally of the same type as 30 in FIGS. 1 to 4 but may be varied by having comers 114 weakened internally to allow for increased flexing and internal stiffening ribs may be provided in the region of the junctions with the co-extruded gasket material.

Figure 8:
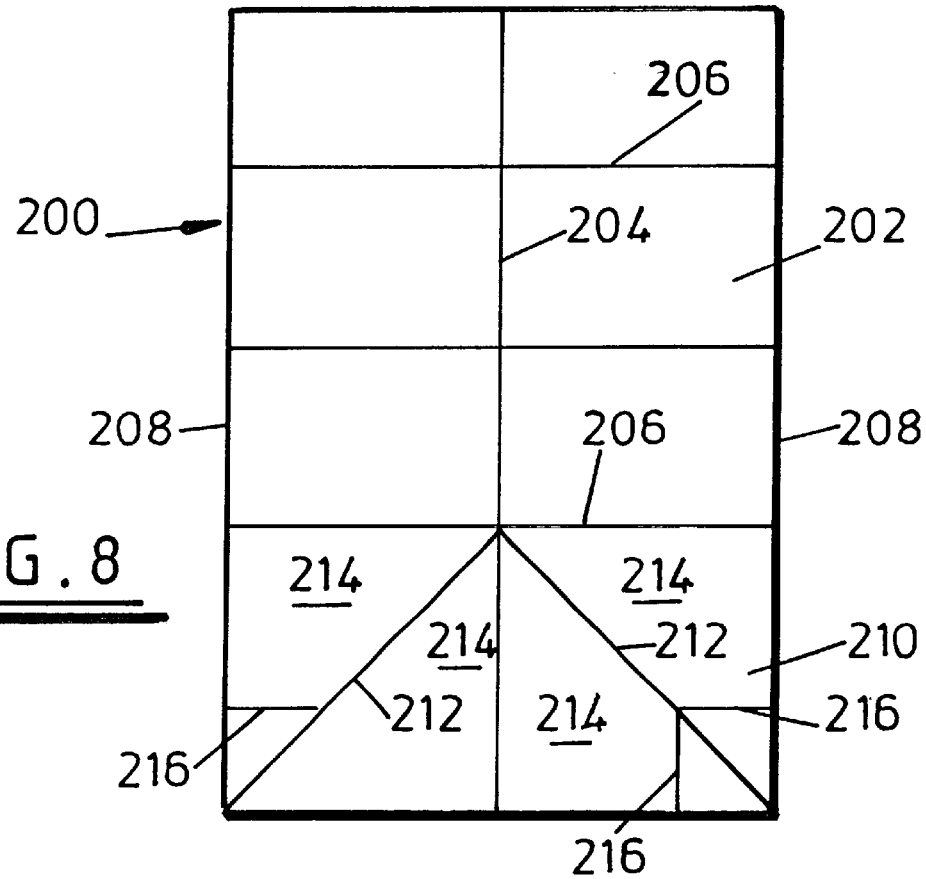
FIG. 8 shows a schematic plan view of a typical Georgian style conservatory.

Turning to FIG. 8, a plan view of a Georgian style conservatory 200 is shown for various reasons. Such a conservatory has a hipped roof with a first part 202 having a ridge 204 and transom roof beams 206 extending at right angles therefrom down to eaves 208. The hipped part 210 of the roof has a pair of roof beams 212 extending downwards from the ridge end to comers of the roof. Because of the steepness of the angle of these roof beams 212 and consequently the angle of the glazing panels 214, the roof beams 212 and their comers cappings have to be different in shape from the transom roof beams which may be of the type illustrated in FIG. 1, 3 or 6. The different shape will be explained below with reference to FIG. 9 of the drawings.

Another feature of the Georgian style conservatory, and possibly other styles, is the inclusion of so-called jack rafters which connect the diagonal roof beams such as 212 in FIG. 8, to the eaves. In FIG. 8 on one side two such rafters 216 are shown but on the other side only one rafter is shown. The latter situation is a typical example of where uneven loading may occur on a roof beam. Hence in that situation it is desirable that the roof beams have some resistance to torsional forces.

Figure 9:
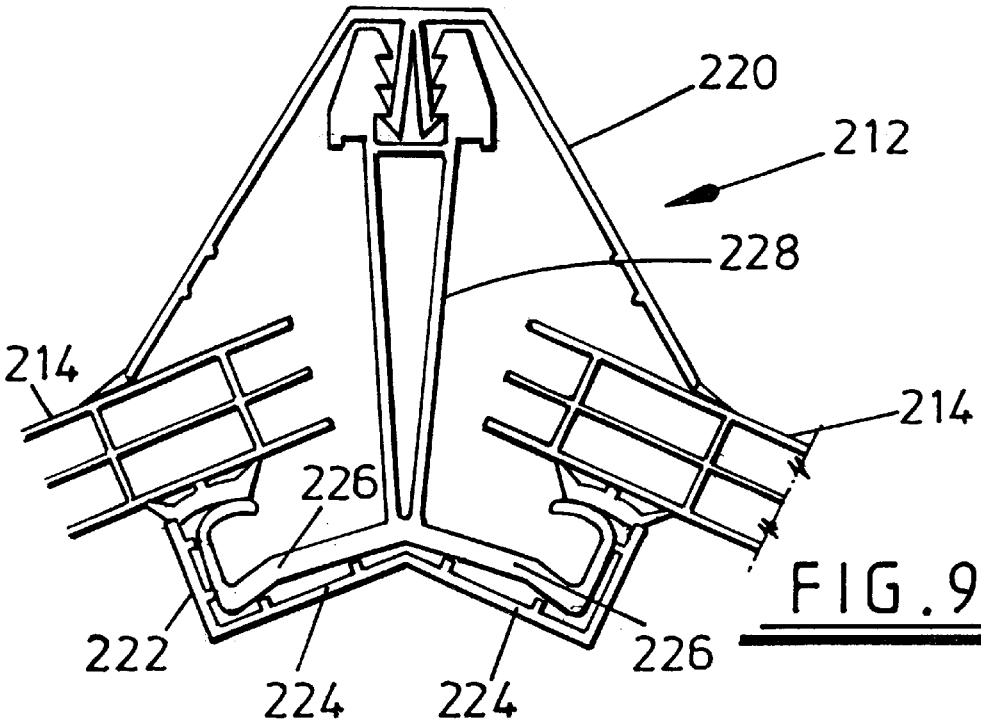
FIG. 9 shows a roof beam arrangement for use in a Georgian style conservatory.

A suitable roof beam 212 for use in the above-described Georgian style situation is shown in FIG. 9 of the drawings. The roof beam 212 is similar to that of FIG. 7 of the drawing except in respect of the upper capping 220, which has longer sides to meet the glazing panels 214 which are more steeply angles, its lower capping 222 which has its facets 224 including a smaller angle than those of the capping 112', and flanges 226 of the glazing bar are correspondingly angled relative to the upstanding limb 228 of the glazing bar, which is an inverted triangular box section.

Figure 10:
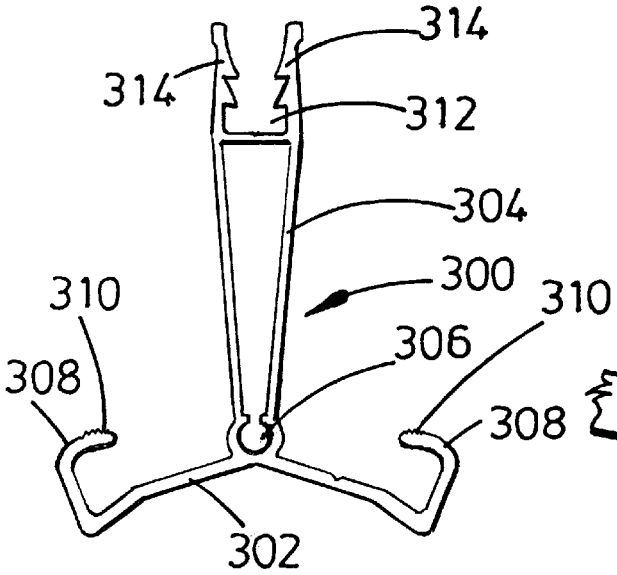
FIG. 10 shows a sixth roof beam according to the invention.
Figure 11:
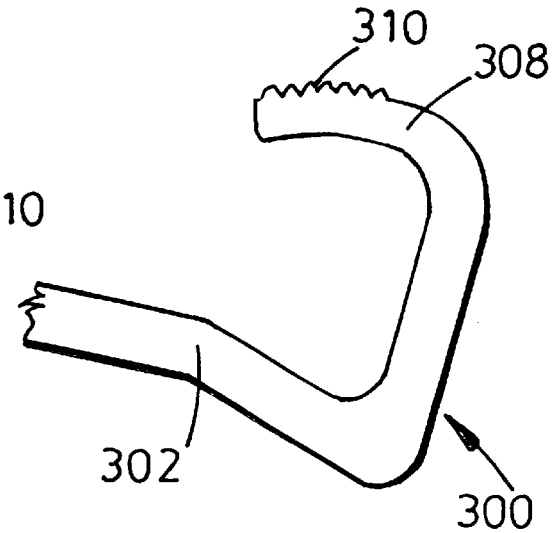
FIG. 11 shows detail of the roof beam of FIG. 10.

FIGS. 10 and 11 show a glazing bar 300 similar to that of FIG. 9 with modifications that will only be described. Where cross bar 302 and upstanding ducted limb 304 intersect is formed a screw/bolt port 306, which enables the glazing bar to be fixed to another component of a roof system by means of a screw/bolt or other suitable fixing means through the component and into the port 306.

The cross bar returns 308 have their top surface 310 serrated to provide extra grip for gaskets of lower cappings that are located on the cross bar in the same way as shown, for example, in FIG. 9. The serrations are lengthwise of the glazing bar. This feature may also be incorporated in all of the glazing bars illustrated herein.

The glazing bar 300 has a channel 312 formed at the remote end of the limb 304 to receive a capping, such as 12 shown in FIG. 1. The inside surfaces of the sides 314 of the channel are notched to retain the depending flaps of the capping. To facilitate fitting of the capping, upper parts of the channel side walls are slightly curved and converge downwardly.

Figure 13:
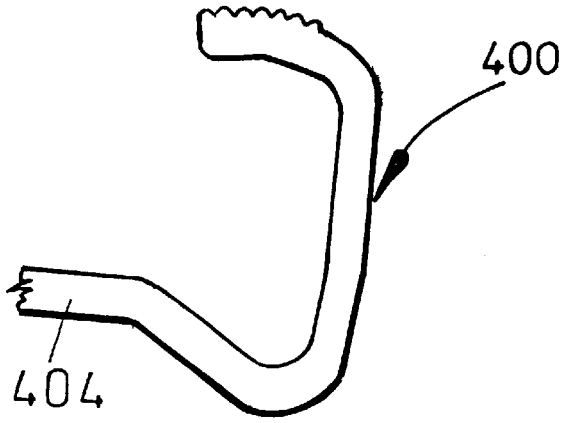
FIG. 13 shows detail of the roof beam of FIG. 12.
Figure 12:
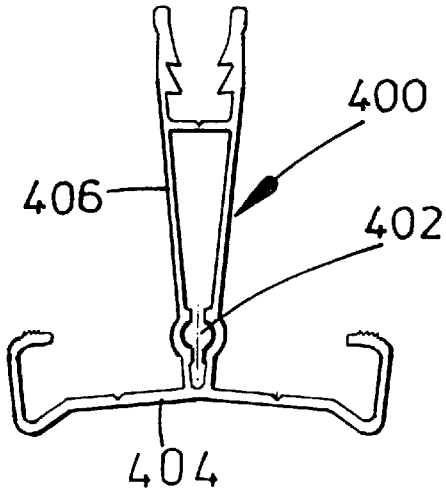
FIG. 12 shows a seventh roof beam according to the invention.

FIGS. 12 and 13 show a glazing bar 400 similar to that of FIGS. 10 and 11 except that its screw port 402 is formed a short distance above the intersection of cross bar 404 and upstanding limb 406.

Figure 14:
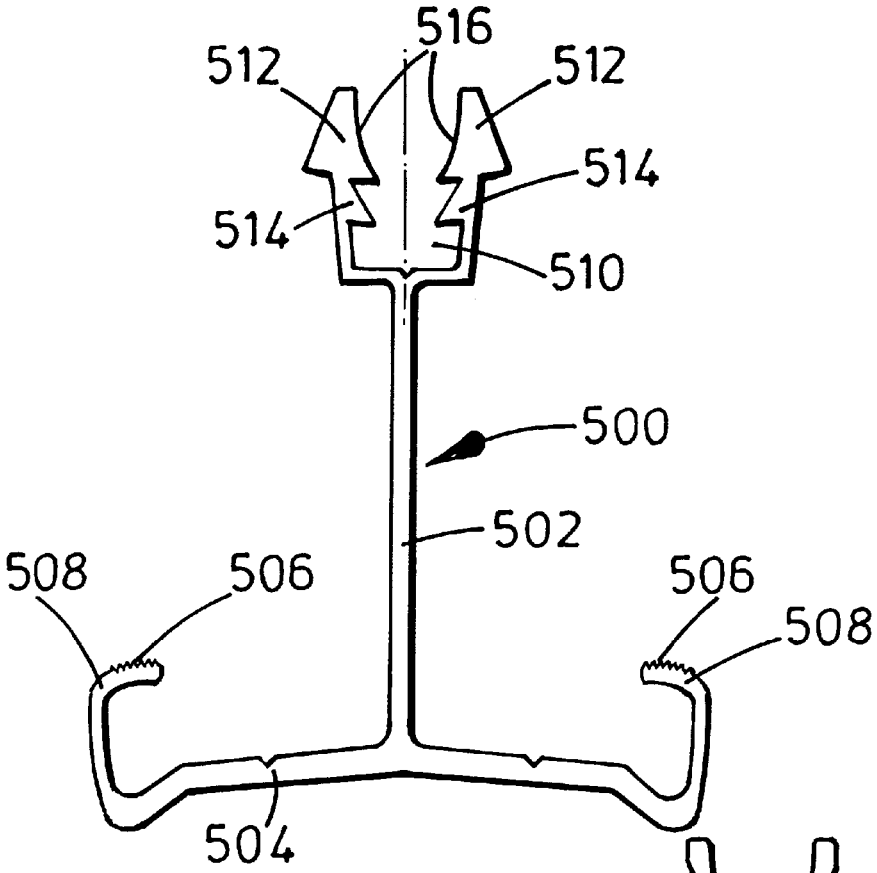
FIG. 14 shows an eighth roof beam according to the invention.

The glazing bar variation 500 shown in FIG. 14 has a single web upstanding limb 502 and a cross bar 504 of the same type as shown in FIG. 12 with top surfaces 506 of returns 508 serrated. The limb 502 has a channel section 510 at its free end as in the other embodiments to receive a capping. Upper parts 512 of the channel section side walls 514 are generally triangular in section. Inside surfaces 516 thereof are slightly curved and converge downwardly.

Figure 15:
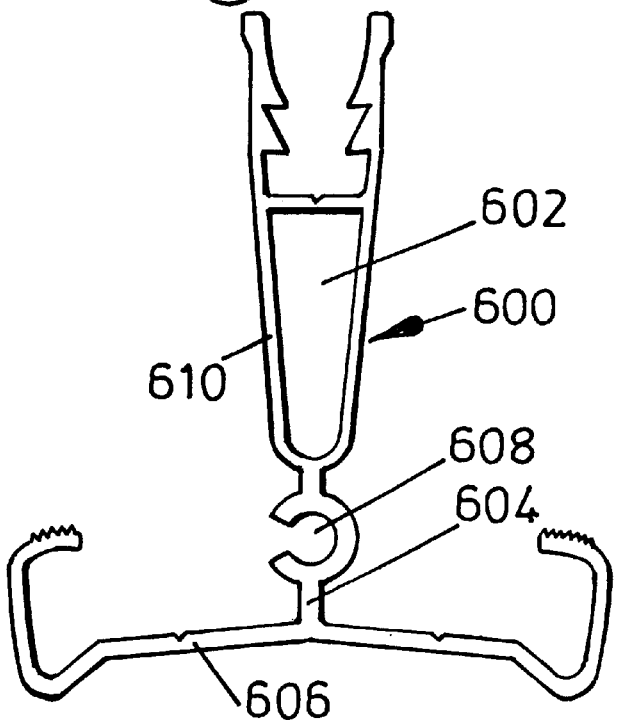
FIG. 15 shows a ninth roof beam according to the invention.
Figure 20:
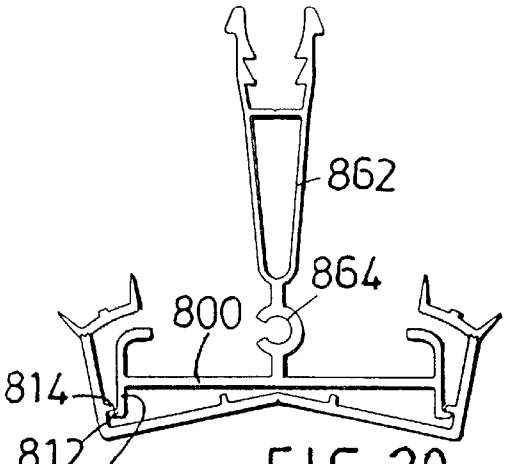
FIGS. 16 to 47 show various forms of glazing bar and lower cappings therefor accounting to the invention.
Figure 21:
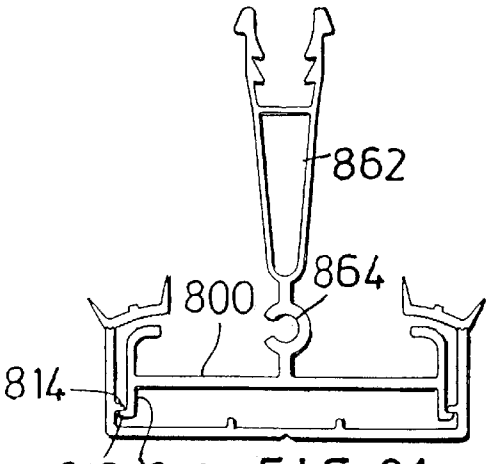
Figure 17:
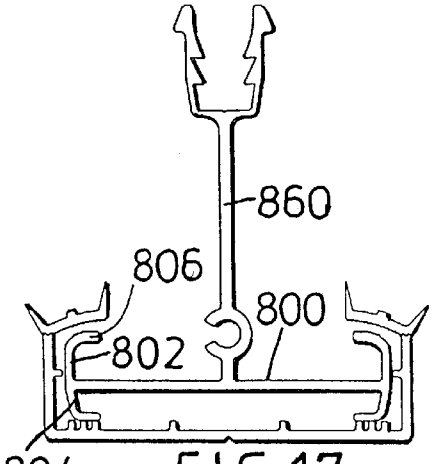
Figure 19:
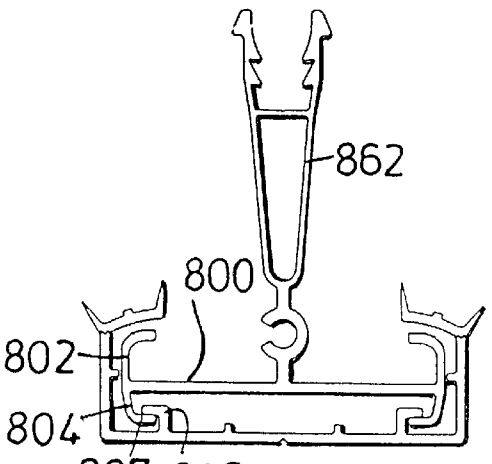
Figure 16:
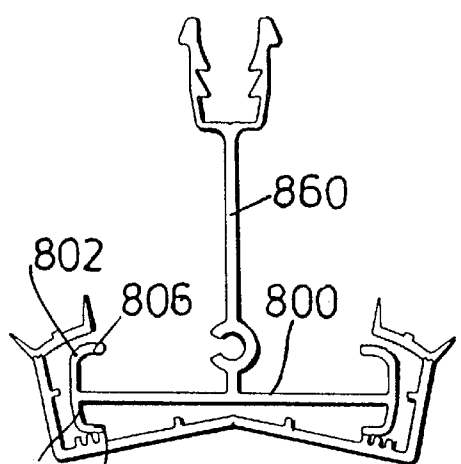
Figure 18:
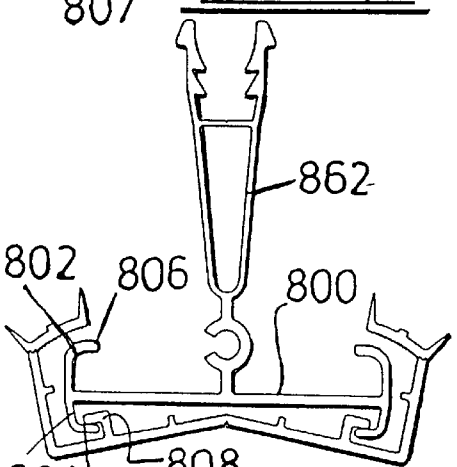
Figure 26:
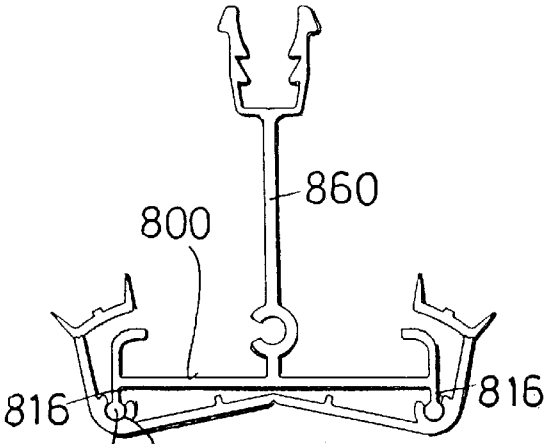
Figure 27:
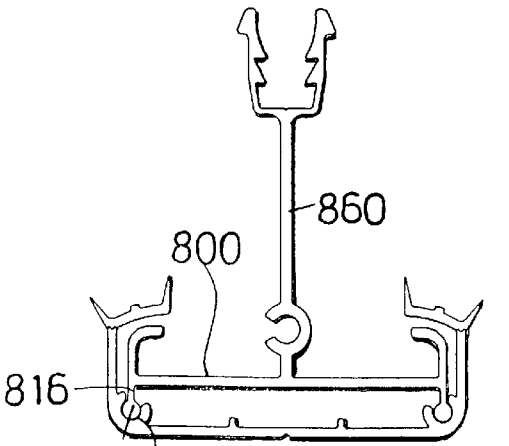
Figure 23:
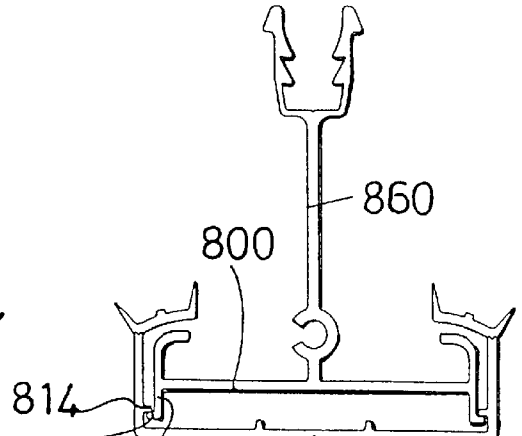
Figure 25:
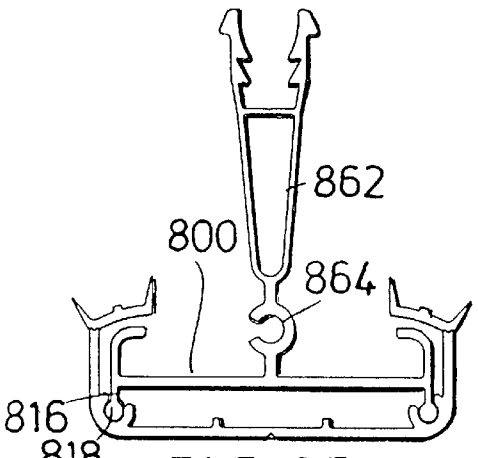
Figure 22:
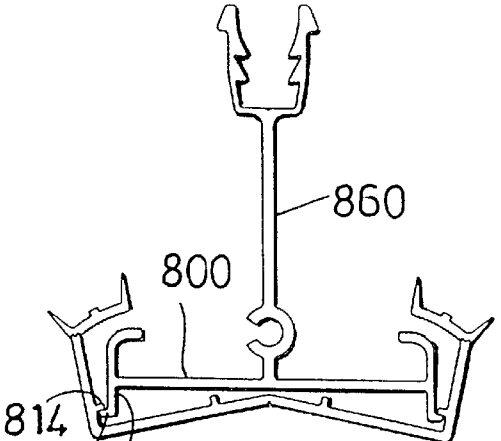
Figure 24:
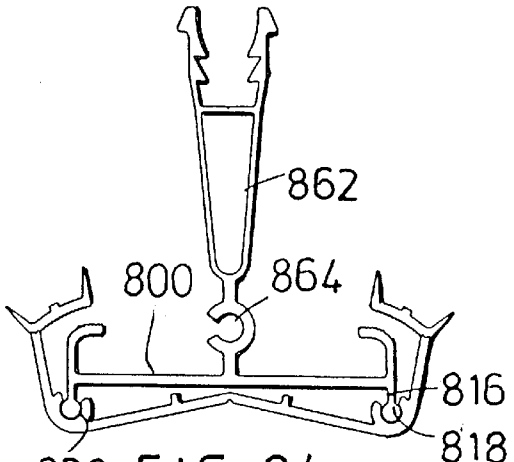
Figures 28, 29, 30, 31, 32, 33:
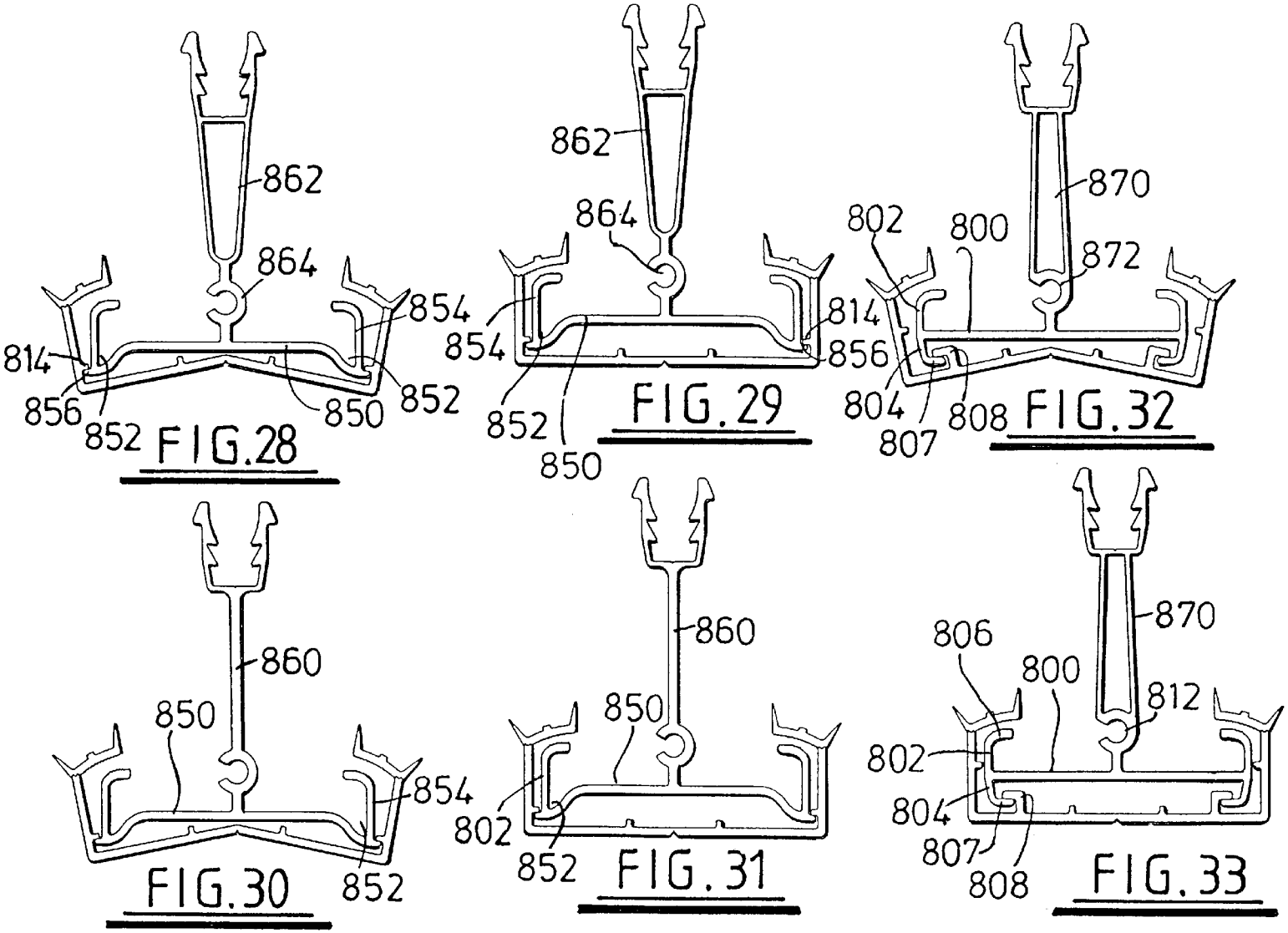
Figure 38:
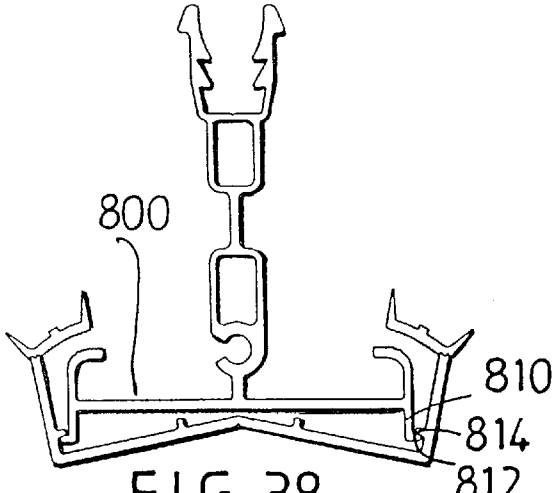
Figure 39:
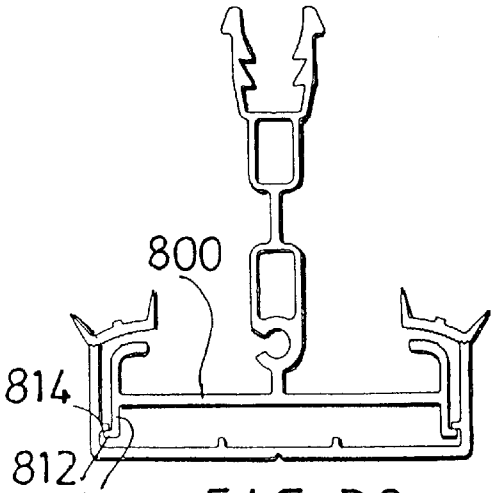
Figure 35:
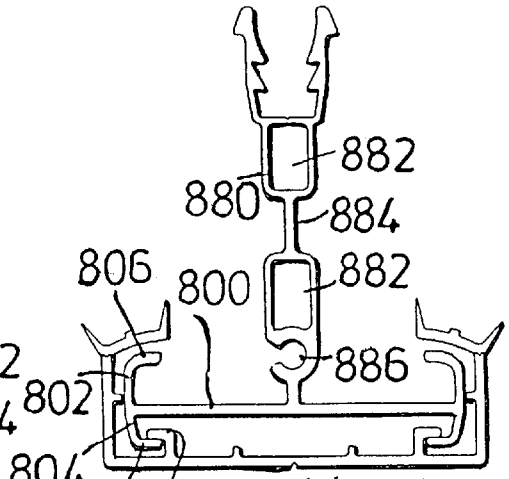
Figure 37:
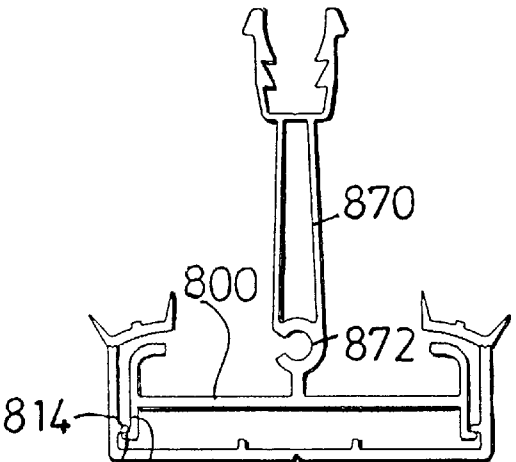
Figure 34:
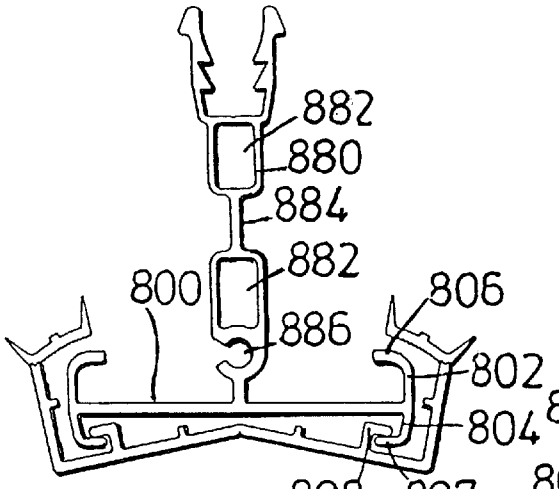
Figure 36:
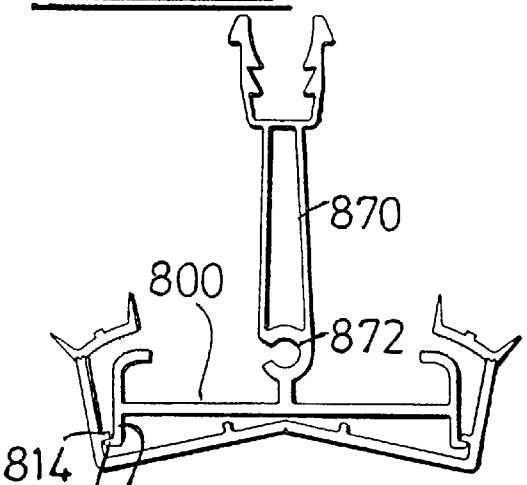
Figure 44:
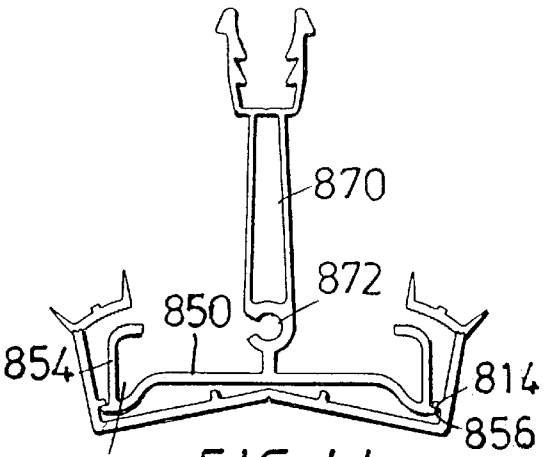
Figure 45:
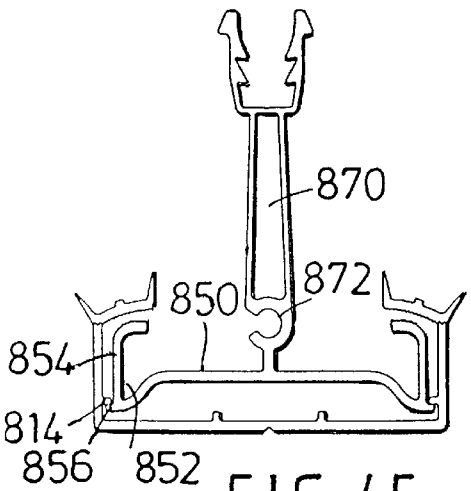
Figure 41:
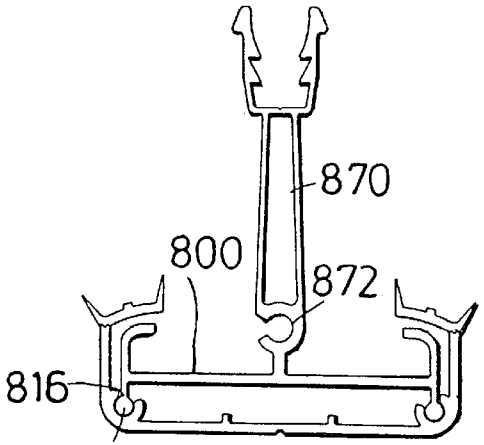
Figure 43:
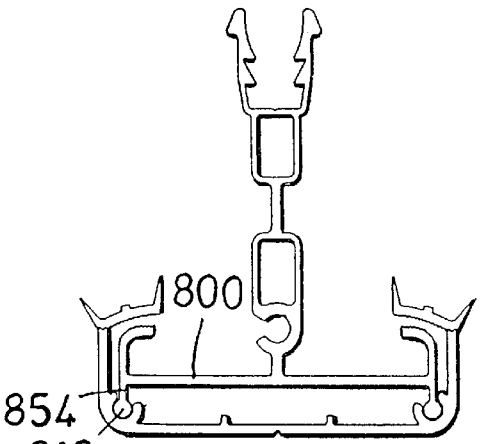
Figure 40:
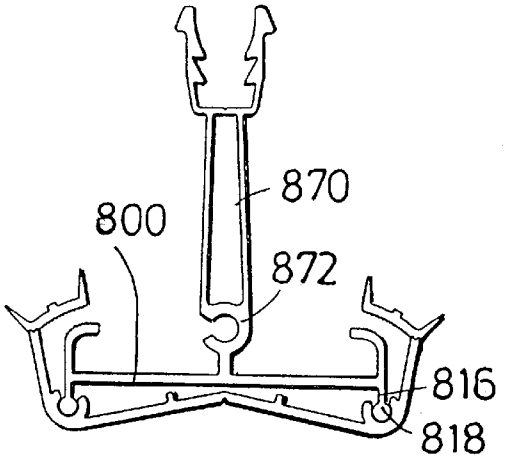
Figure 42:
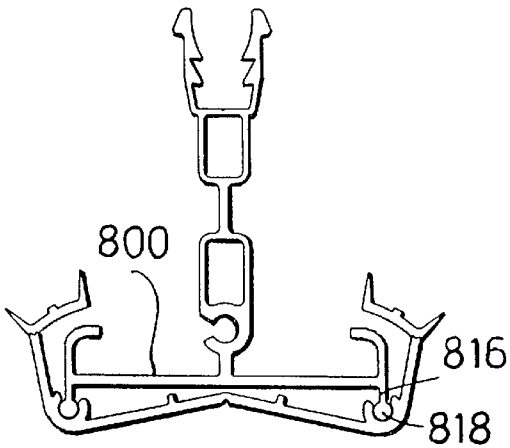
Figure 46:
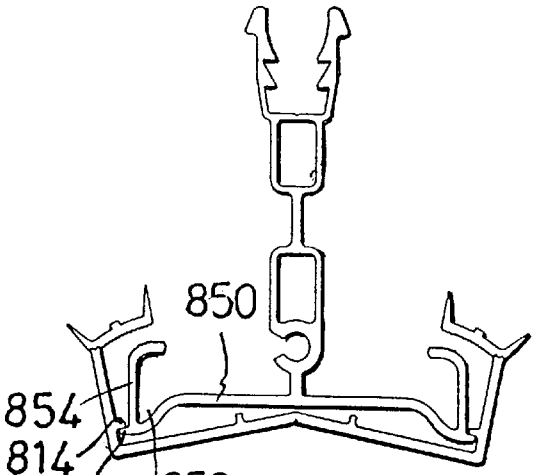
Figure 47:
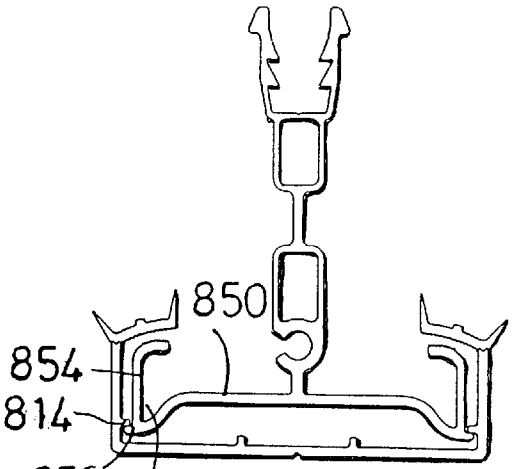

In FIG. 15, there is shown a glazing bar 600 similar to that of FIG. 12, except that its upstanding limb 602 has a first part 604 extending from cross bar 606 that has a single web and includes a screw port 608 and a second double web ducted port 610.

FIGS. 16 to 47 show variations of glazing bar and lower capping combinations. In FIGS. 16 to 27 and 32 to 43 the glazing bar has a cross bar 800 that is flat but at each end are flanges extending upwardly and downwardly. Upper flanges 802 have inward returns 806 that are ribbed on their top surface for providing grip with the underside of the co-extruded gaskets of the lower cappings.

Lower flanges 804 in the embodiments of FIGS. 16 to 19 and 32 to 35 are returned inwards to provide hook like formations 807 that engage complementary formations 808 internally of the lower capping.

Lower flanges 810 in the embodiments of FIGS. 20 to 23 and 36 to 39 have outwardly projecting lips 812 engage below complementary ribs 814 internally of the lower capping.

Lower flanges 816 of the embodiments of FIGS. 24 to 27 and 40 to 42 end with a bead 818 that is a snap-fit into complementary slots 820 in corners of the lower capping.

In FIGS. 28 to 31 and 44 to 47, the glazing bars have a cross bar 850 that has a flat central section, a trough 852 at each end and upstanding side walls 854. At the base of the side walls are outwardly extending ribs 856 that can engage under complementary internal ribs 814 of the lower capping.

In FIGS. 16, 17, 22, 23, 26, 27, 30 and 31 the glazing bars have a single web stem 860. In FIGS. 18 to 21, 24, 25, 28 and 29, the glazing bars have a ducted stem 862 with a screw port 864 between the duct and the cross bar. The duct is generally an inverted isosceles triangle in section.

In FIGS. 32, 33, 36, 37, 44 and 45, the glazing bars have ducted sterns 870 but tapering upwardly. A screw port 872 is provided between the duct and the cross bar.

In FIGS. 34, 35, 38, 39, 42, 43, 46 and 47, the glazing bars have stems 880 having two ducted sections 882 connected by a single web 884. A screw port 886 is provided between the lowermost duct and the cross bar.

Figure 48:
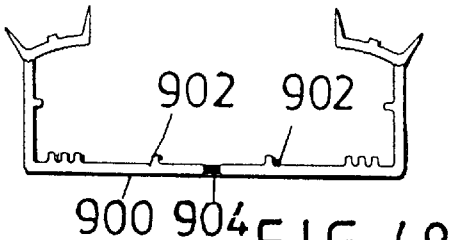
FIGS. 48 to 50 show variations on lower cappings for glazing bars according to the invention.
Figure 49:
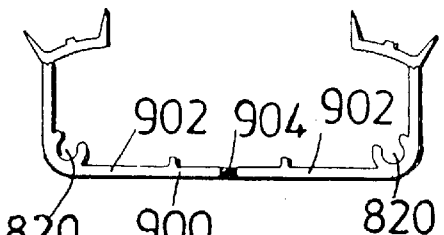
Figure 50:
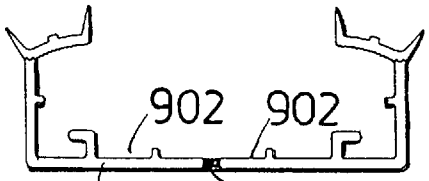

Finally in FIGS. 48 to 50, variations of the lower capping are shown. The main difference between these cappings and the previously described cappings is that each capping has a base 900 that is formed in three co-extruded parts i.e. between outer parts 902 of the cappings is a co-extruded strip of flexible material 904, such as of rubber or of other elastomeric material, whereby the cappings can be opened out to facilitate fitting thereof to glazing bars.

The roof beam arrangements of FIGS. 1 to 4, 6, 7 and 9 to 47 are used in the following manner. The glazing bar is fixed between lateral beams of a roof under construction, such as between the ridge and the eaves, and the lower capping fixed onto the glazing bar. The roofing panels are laid on opposite sides of the reinforcing bar on top of the gaskets of the lower capping. Then the upper capping is pressed into place onto the reinforcing bar to hold the roofing panels in place, the gaskets of the upper and lower cappings providing good seals above and below the roofing panels.

By providing sealing gaskets on the capping and the lower cappings instead of separately therefrom, the number of procedural steps for constructing a roof are reduced, so that the construction can be simpler and quicker than hitherto. Furthermore, as the same type of glazing bar can be used in different situations in the same conservatory, i.e. without the need for two different styles of glazing bar, cost may be reduced and erection of the conservatory may be simplified.

What is claimed is:

1. A roof beam for use in forming a conservatory roof, comprising a glazing bar and upper and lower cappings fitted thereto the glazing bar being of generally inverted T-section providing a cross bar and an upstanding limb, the cross bar having a central section and edges in the form of side walls extending above and below the central section to form a recess in the underside of the glazing bar and bottom edges of the side walls having formations thereon for positive engagement with the lower capping, the lower capping comprising a channel section with co-extruded gaskets along edges thereof fitted over upper parts of the side walls.

2. A roof beam as claimed in claim 1, wherein the upper parts of the glazing bar side walls have inward returns.

3. A roof beam as claimed in claim 1, wherein the side walls of the glazing bar are parallel to the plane of the upstanding limb.

4. A roof beam as claimed in claim 1, wherein the inward returns of the side walls of the glazing bar have arcuate top surfaces.

5. A roof beam as claimed in claim 2, wherein the inward returns top surfaces of the side walls of the glazing bar are profile or roughened.

6. A roof beam as claimed in claim 1, wherein the upstanding limb of the glazing bar includes a port for receiving a fixing screw or bolt.

7. A roof beam as claimed in claim 1, wherein the lower capping has a pair of ribs and lower parts of the side walls of the glazing bar have lateral ribs that engage under the ribs of the lower capping.

8. A roof beam as claimed in claim 7, wherein the lateral ribs extend outwards and the ribs of the lower capping extend inwards from sides thereof.

9. A roof beam as claimed in claim 7, wherein the lateral ribs extend inwards and the ribs of the lower capping extend upwardly and outwardly from its base.

10. A roof beam as claimed in claim 1, wherein bottom edges of the glazing bar side walls have beads thereof that snap-fit into corresponding slots of the lower capping.

11. A roof beam as claimed in claim 1, wherein the lower capping has lengthwise a flexible central strip.

* * * * *